US009515441B2

(12) United States Patent
Fattu et al.

(10) Patent No.: US 9,515,441 B2
(45) Date of Patent: Dec. 6, 2016

(54) CABLE CONNECTOR GROUPING APPARATUS

(71) Applicant: International Business Machines Corporation, Armonk, NY (US)

(72) Inventors: Khajistha Fattu, Austin, TX (US); Rachael C. Freitas, Austin, TX (US); Murali Neralla, Austin, TX (US); Madeline Vega, Austin, TX (US); George Zacharakis-Jutz, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/701,289

(22) Filed: Apr. 30, 2015

(65) Prior Publication Data

US 2016/0322766 A1 Nov. 3, 2016

(51) Int. Cl.
*H01R 13/60* (2006.01)
*H01R 27/02* (2006.01)
*H01R 43/20* (2006.01)

(52) U.S. Cl.
CPC ..... *H01R 27/02* (2013.01); *H01R 43/20* (2013.01)

(58) Field of Classification Search
CPC ..... H01R 13/518; H01R 13/659
USPC ..... 439/540.1, 480, 344
See application file for complete search history.

(56) References Cited

U.S. PATENT DOCUMENTS 1,870,274 A * 8/1932 Wulfert ..... H01B 17/265 126/317
3,246,283 A * 4/1966 Huska ..... H01R 9/26 439/716
3,369,166 A * 2/1968 Lake ..... H01F 27/40 174/139
3,803,535 A * 4/1974 Wilson ..... H01R 13/518 248/27.1
5,135,413 A * 8/1992 Pannizzo ..... E06B 7/28 174/481
6,999,305 B1 * 2/2006 Calcote ..... H02B 1/01 174/50
7,140,911 B1 11/2006 Rector et al.
7,503,802 B2 3/2009 Tu et al.
2011/0312203 A1 12/2011 Liu et al.

* cited by examiner

*Primary Examiner* — Phuong Dinh
(74) *Attorney, Agent, or Firm* — Lieberman & Brandsdorfer, LLC

(57) ABSTRACT

The embodiments relate to an apparatus allowing for the insertion and removal of multiple like and/or unlike connectors simultaneously without requiring permanent connector modification. The apparatus includes at least a first housing and a second housing. The first housing receives a first connector and the second housing receives a second connector. The first housing has a first variable aperture and the second housing has a second variable aperture. The first aperture is adjusted by a first retainer to hold the first connector in the first housing. The second aperture is adjusted by a second retainer to hold the second connector in the second housing. The first housing has a first exterior wall sized to receive and secure a second exterior wall of the second housing to form an assembly of the connectors.

19 Claims, 7 Drawing Sheets

CABLE CONNECTOR GROUPING APPARATUS

BACKGROUND

The present detailed description relates to a cable connector for an electronic component. More specifically, the embodiments relate to an assembly for managing multiple connectors, including adjacently positioned heterogeneous interfaces.

With systems of electronic enclosures, there is often a need to connect multiple external cables from one enclosure to another between enclosure interfaces. Such enclosure interfaces may include a high number of homogenous and heterogeneous connector interfaces. In certain cases, providing technical service to an enclosure requires the removal of some or all the connectors from the enclosure interface. There is also the possibility that there will be limited accessibility for removing the connectors due to spatial constraints. If there are a high number of connector interfaces, a service technician may spend an excessive amount of time removing and inserting the connectors. There is also the risk that connectors and associated extensions may be reoriented during the service process, potentially causing severe or irreparable damage to the enclosure interfaces.

Assemblies used for management of connectors are known in the art, and primarily include bundling or otherwise grouping associated extensions for organization and to remove clutter. However, bundling does not prevent the mix up of associated connectors to the electronic enclosure. Other known assemblies focus on adapters that allow for multiple connectors to be condensed, or otherwise streamlined, into a single connector. However, the condensed connectors do allow for mass organization of a grouping of heterogeneous connectors. There are other known assemblies that modify the connector end to condense the connection process. However, such assemblies require permanent modification of an original connector design and reduce the flexibility of the associated interface. Connector modification also inhibits rapid reconfiguration of a system of multiple electronic enclosures.

SUMMARY

The disclosure includes an apparatus, method, and system for managing multiple homogeneous and heterogeneous connectors for associated electronic components.

In one aspect, an apparatus is provided to allow for the insertion and removal of multiple like and/or unlike connectors simultaneously without requiring permanent connector modification. The apparatus includes at least a first housing and a second housing. The first housing receives a first connector and the second housing receives a second connector. The first housing has a first variable aperture and the second housing has a second variable aperture. The first aperture is adjusted by a first retainer to hold the first connector in the first housing. The second aperture is adjusted by a second retainer to hold the second connector in the second housing. The first housing has a first external wall sized to receive and secure a second external wall of the second housing to form an assembly of the connectors.

In another aspect, a method is provided for use with a formation of an assembly housing multiple connectors. The method includes forming a housing assembly, including securing a first housing to a second housing. The first housing has a secondary opening received by an extension of the second housing. The first housing includes a first central aperture to receive a first connector and the second housing includes a second central aperture to receive a second connector. A first connector is retained in the first central aperture of the first housing, which includes adjusting the first central aperture of the first housing, and a second connector is retained in the second central aperture of the second housing, which includes adjusting the second central aperture of the second housing.

In yet another aspect, a system is provided for use with a formation of an assembly of housings. Each of the housings within the assembly is configured to receive a connector. The system includes an assembly configured to receive a plurality of connectors, each connector received in a separate housing within the assembly. Each of the housings in the assembly has a separate retainer, including a first retainer for a first housing and a second retainer for a second housing. An independent adjustment for each retainer separately modifies an associated central aperture for each of the housings.

These and other features and advantages will become apparent from the following detailed description of the presently preferred embodiment(s), taken in conjunction with the accompanying drawings.

BRIEF DESCRIPTION OF THE SEVERAL VIEWS OF THE DRAWINGS

The drawings referenced herein form a part of the specification. Features shown in the drawings are meant as illustrative of only some embodiments, and not of all embodiments unless otherwise explicitly indicated.

DETAILED DESCRIPTION

It will be readily understood that the components, as generally described and illustrated in the Figures herein, may be arranged and designed in a wide variety of different configurations. Thus, the following detailed description of the embodiments of the apparatus, system, and method, as presented in the Figures, is not intended to limit the scope, as claimed, but is merely representative of selected embodiments.

Reference throughout this specification to "a select embodiment," "one embodiment," or "an embodiment" means that a particular feature, structure, or characteristic described in connection with the embodiment is included in at least one embodiment. Thus, appearances of the phrases "a select embodiment," "in one embodiment," or "in an embodiment" in various places throughout this specification are not necessarily referring to the same embodiment.

The illustrated embodiments will be best understood by reference to the drawings, wherein like parts are designated by like numerals throughout. The following description is intended only by way of example, and simply illustrates certain selected embodiments of devices, systems, and processes that are consistent with the embodiments as claimed herein.

The term "housing" as used herein should be broadly construed to include any device designed to hold one or more connectors in place. The term "aperture" as used herein refers to the space defined by the interior of the housing. In each of the embodiments, the aperture of the housing may be variably adjusted, which allows the housing to hold one or more connectors in place without requiring any permanent structural modifications to the housing or connector. The term "interface" as used herein refers to connection of one computer or piece of equipment with another computer or piece of equipment. It is to be appreciated that the term "connector" as used herein should be broadly construed to include any device that provides a connection between an interface and a cable. A non-exhaustive list of connectors includes Serial Attached SCSI (SAS) connectors, mini-SAS connectors, Parallel SCSI connectors, Serial ATA (SATA) connectors, Parallel ATA (PATA) connectors, Ethernet connectors, etc.

Figure 1:
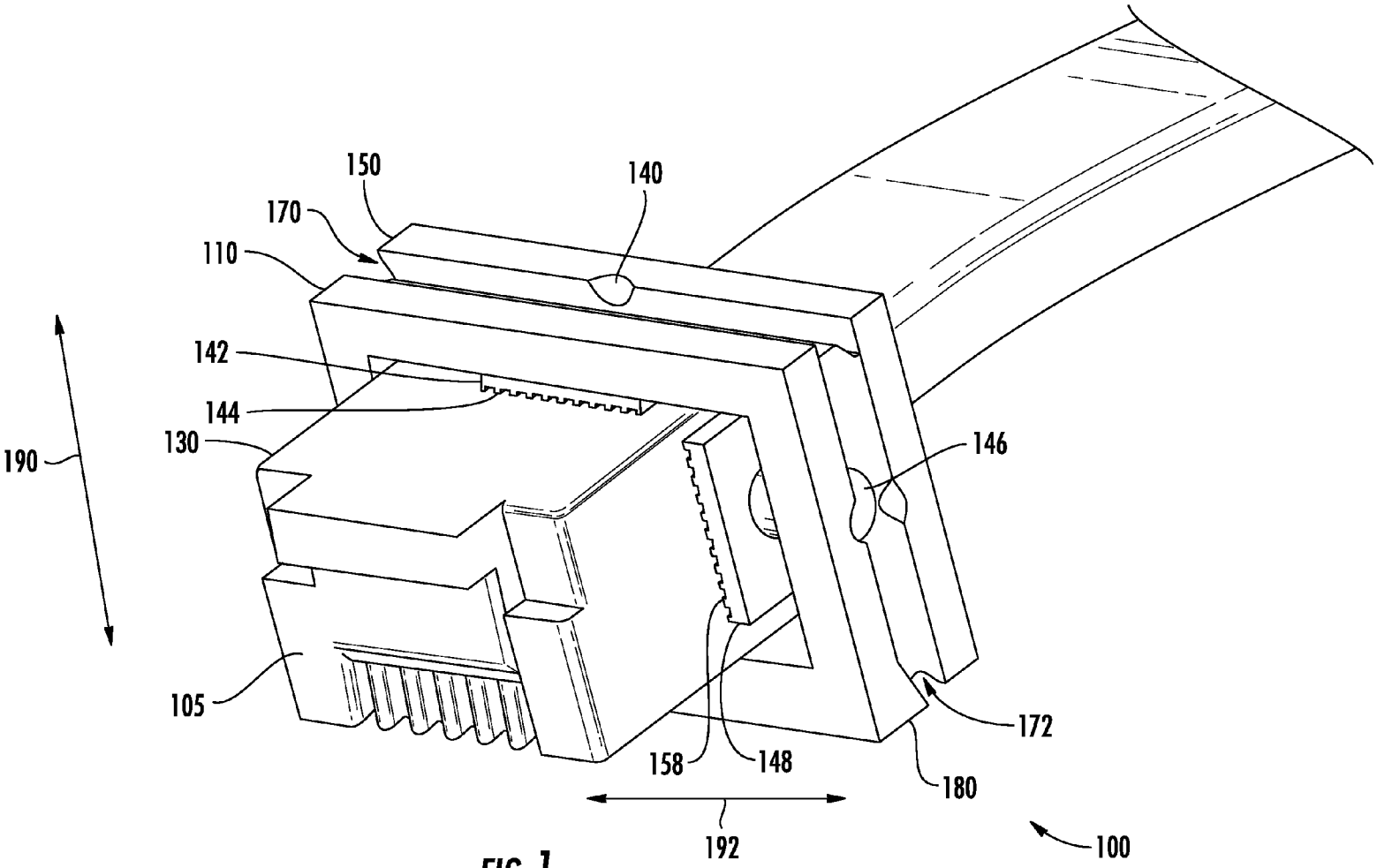
FIG. 1 depicts a perspective view of a housing configured to receive a connector.

With reference to FIG. 1, a perspective view of a housing (100) is shown. The housing (100) is provided with two separate walls, including a first wall (110) and a second wall (150). A primary aperture (130) is positioned between the two walls (110) and (150), and is configured and sized to receive a connector (105). In the example shown herein, the connector (105) is shown positioned within the primary aperture, with the walls (110) and (150) of the housing (100) forming a perimeter around the connector (105). A set of secondary openings (170) and (172) are shown formed between the two walls (110) and (150). In one embodiment, the first secondary opening (170) extends in a first direction, and the second secondary opening (172) extends in a second direction. In one embodiment, the first and second directions are different directions. In one embodiment, the first secondary opening (170) is perpendicular to the second secondary opening (172). The first and second secondary openings (170) and (172), respectively, are both sized to receive an extension. In one embodiment, the extension is a tapered projection, also referred to as a dovetail joint having one or more tapered projections that is sized to be received by and to interlock with a corresponding recess. An example of the extension is shown at (180), also referred to as a first extension, and perpendicular to the secondary opening (170). In one embodiment, the extension is a dovetail joint having one or more tapered projections that are sized to be received by and to interlock with a corresponding recess as shown at secondary openings (170) and (172). In one embodiment, the extension (180) may have an alternative shape, with the limitation that the secondary openings (170) and (172) are sized and configured to receive and hold the associated extensions. It is to be appreciated that the dovetail mechanism is just one example of a means to secure the housings to form the assembly of connectors. Other means of securing external walls of housings to form an assembly of connectors may be readily apparent to those skilled in the art.

The secondary openings (170) and (172) formed by the walls (110) and (150) enable multiple housings (100) to be joined. More specifically, the tapered extension(s), such as that shown at (180) are received and secured in a corresponding secondary opening, such as that shown at (170), to form a union of at least two housings. In one embodiment, and as shown and described in FIGS. 2 and 4, multiple housings are secured and form a housing assembly. Each individual housing within the assembly has at least one secondary opening (170) and (172) sized and configured to receive an associated extension (180).

Referring to FIG. 1, the housing (100) includes an adjuster (140), also known as a retainer, to configure the primary aperture (130). More specifically, the adjuster (140) conforms the variable size of the primary aperture (130) to the size of a connector (not shown) received therein. As the connector is received in the primary aperture (130) of the housing (100), the adjuster (140) either enlarges the size of the primary aperture (130) or decreases the size of the primary aperture (130). In one embodiment, the adjustment of the primary aperture size is limited to the perimeter of housing (100) as formed by the walls. As shown herein, the adjuster (140) is shown positioned in the first secondary opening (170). The adjuster (140) includes an associated adjuster wall (142) that is configured to communicate with and contact an external wall of a connector received in the primary aperture (130). In one embodiment, the adjuster (140) is configured to be rotated, with the rotation to project the adjuster wall (142) further into the primary aperture (130). For example, in one embodiment, a rotation of the adjuster (140) in a first direction narrows the size of the primary aperture (130) and a rotation of the adjuster (140) in a second direction extends the size of the primary aperture (130), with the limit of the extension being the walls of the housing. In one embodiment, the adjuster wall (142) has an external surface (144) with a high friction component to further engage and hold the connector within the housing. The adjuster (140) is positioned within the first secondary openings (170) formed between the two walls (110) and (150) without interfering or causing interference with the extension (180) adapted to be received in opening (170).

The housing (100) may be configured with one adjuster (140), also referred to herein as a first adjuster, or in one embodiment, with a second adjuster (146). As shown herein, the first adjuster (140) is positioned with respect to the housing (100) to control the size of the primary aperture in a first direction (190). The second adjuster (146) is positioned with respect to the housing (100) to control the size of the primary aperture in a second direction (192). In one embodiment, the first direction (190) is perpendicular to the second direction (192). Similar to the first adjuster (140), the second adjuster (146) may be rotated in the first direction to narrow the size of the primary aperture (130), with rotation in the second direction to extend the size of the primary aperture (130), with the limit of the extension being the walls of the housing. In an embodiment and similar to the first adjuster (140), the second adjuster (146) is shown with an adjuster wall (148) having an associated external surface (158) with a high friction component to further engage and hold the connector within the housing. Similarly, in one embodiment, the second adjuster (146) is positioned within the second of secondary opening (172) formed between the walls (110) and (150). Accordingly, the second adjuster (146) provides control of the size of the primary aperture in both a second direction (192), and within the primary aperture (130) enables the primary aperture (130) to be controlled in at least two different directions.

Figure 2:
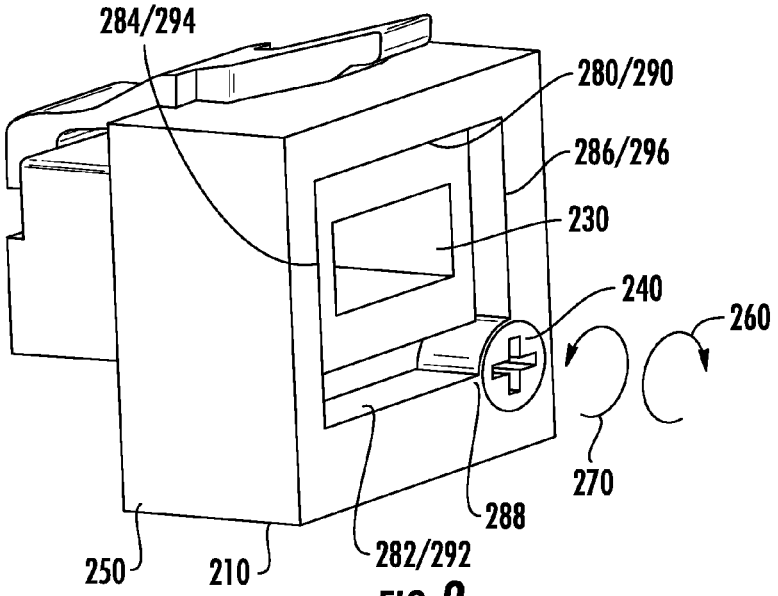
FIG. 2 depicts a housing with a connector positioned therein, and an adjuster for holding the connector in the housing.

The first adjuster (140) in relationship to the aperture (130) shown and described in FIG. 1, includes an associated adjuster wall (142) which changes position based on a changed position of the adjuster (140). Referring to FIG. 2, a block diagram (200) is provided illustrating a housing with a connector positioned therein, and an adjuster for holding the connector in the housing. More specifically, the housing is shown including a first wall (210) and a second wall (250), similarly configured to that of the housing of FIG. 1 so that multiple housings may be attached via their external walls. However, the adjuster (240) shown herein has a different position and configuration. More specifically, the adjuster (240) is positioned within the primary aperture (230) and occupies part of the area of the aperture (230). In one embodiment, the adjuster (240) is a multi-diameter range screw. As the adjuster (240) is rotated in a first direction (260), the diameter of the screw increases and the area of the primary aperture (230) decreases. Conversely, at such time as the adjuster (240) is rotated in a second direction (270), the diameter of the screw decreases and the area of the primary aperture (230) increases.

The aperture (230) is formed and sized by two sets of interior walls. More specifically, first and second oppositely positioned walls (280) and (282), and third and fourth oppositely positioned walls (284) and (286). As shown herein, the adjuster (240) is positioned in a corner (288) formed by walls (282) and (286). Each wall has an exposed interior surface. More specifically, wall (280) has interior surface (290), wall (282) has interior surface (292), wall (284) has interior surface (294), and wall (286) has interior surface (296). As the adjuster (240) is manipulated and the diameter of the adjuster (240) increases, the connector is forced to oppositely disposed walls (280) and (284). In one embodiment, the interior surfaces (290)-(296) are covered with a high friction material or composition, to provide a rough external surface. Accordingly, this high friction surface functions together with the adjuster (240) to hold the connector within the aperture (230).

Figure 3:
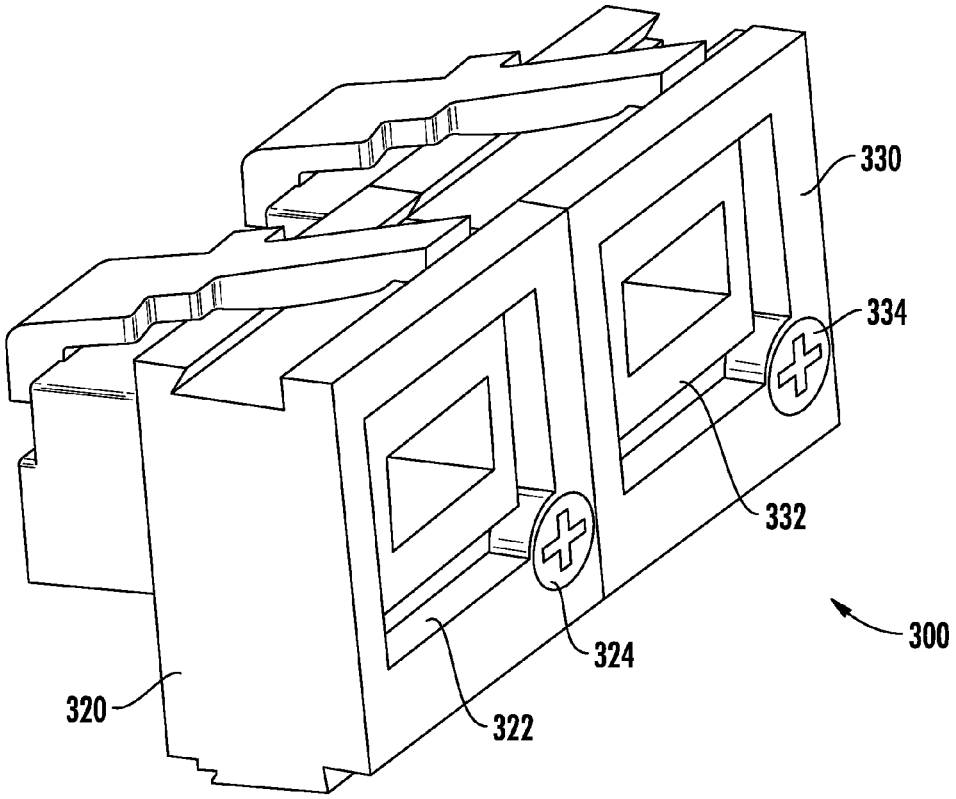
FIG. 3 depicts a block diagram of an assembly of two or more housings.

As shown and described above in FIG. 1, each housing is configured to be assembled in communication with another housing, with the connection forming an assembly of housings. Each housing in the assembly is sized and configured to receive one connector, with the assembly configured to receive multiple connectors. Referring to FIG. 3, a block diagram of an assembly (300) of two housings is provided. In one embodiment, the assembly may be configured with more than two housings, and as such, the assembly should not be limited to two housings. As shown, the assembly (300) includes a first housing (320) and a second housing (330). Each housing (320) and (330) has a separate primary aperture. In the example shown herein, a connector is received in each of the apertures, although in one embodiment, the connectors may be absent. More specifically, the first housing (320) has a first primary aperture (322) and the second housing (330) has a separate second primary aperture (332). The first and second housings (320) and (330) are assembled and held together via the extension(s) and corresponding secondary opening(s), as shown and described in FIG. 1. Each housing (320) and (330) is configured with a separate adjuster or adjusters to separately set the size of the primary apertures (322) and (332) for each housing (320) and (330), respectively. For descriptive purposes, the first housing (320) is shown with a first adjuster (324) to adjust the size of the first primary aperture (322), and the second housing (330) is shown with a second adjuster (334) to adjust the size of the second primary aperture (332). Each primary aperture is sized based on the connector received therein. The aperture sizes may be homogenous or heterogeneous. Accordingly, in the case of an assembly of housings configured to receive two different sized connectors, each primary aperture in each of the housings of the assembly may be separately sized and configured to receive and hold the associated connector.

The assembly shown and described in FIG. 3 includes two interconnected housings, and as such, the assembly (300) receives and holds two connectors. Each housing may also be referred to herein as a building block, with each housing separately configured to be received by and attached to another housing, with the attachment forming an assembly of housings. It is to be further appreciated that the assembly is not limited to an assembly of two connectors or an assembly of two housings, but may be an assembly of three or more connectors formed by securing three or more housings. More specifically, the assembly is highly customizable, and may be constructed to support any number of connectors or housings that are required. This "building-block" type of assembly formation allows for ease of customization and it is to be appreciated that the number of connectors in the assembly is not limited in any way. Accordingly, the assembly may be configured to receive two or more housings, with each separate housing within the assembly separately sized and configured for receipt of an associated connector.

Figure 4:
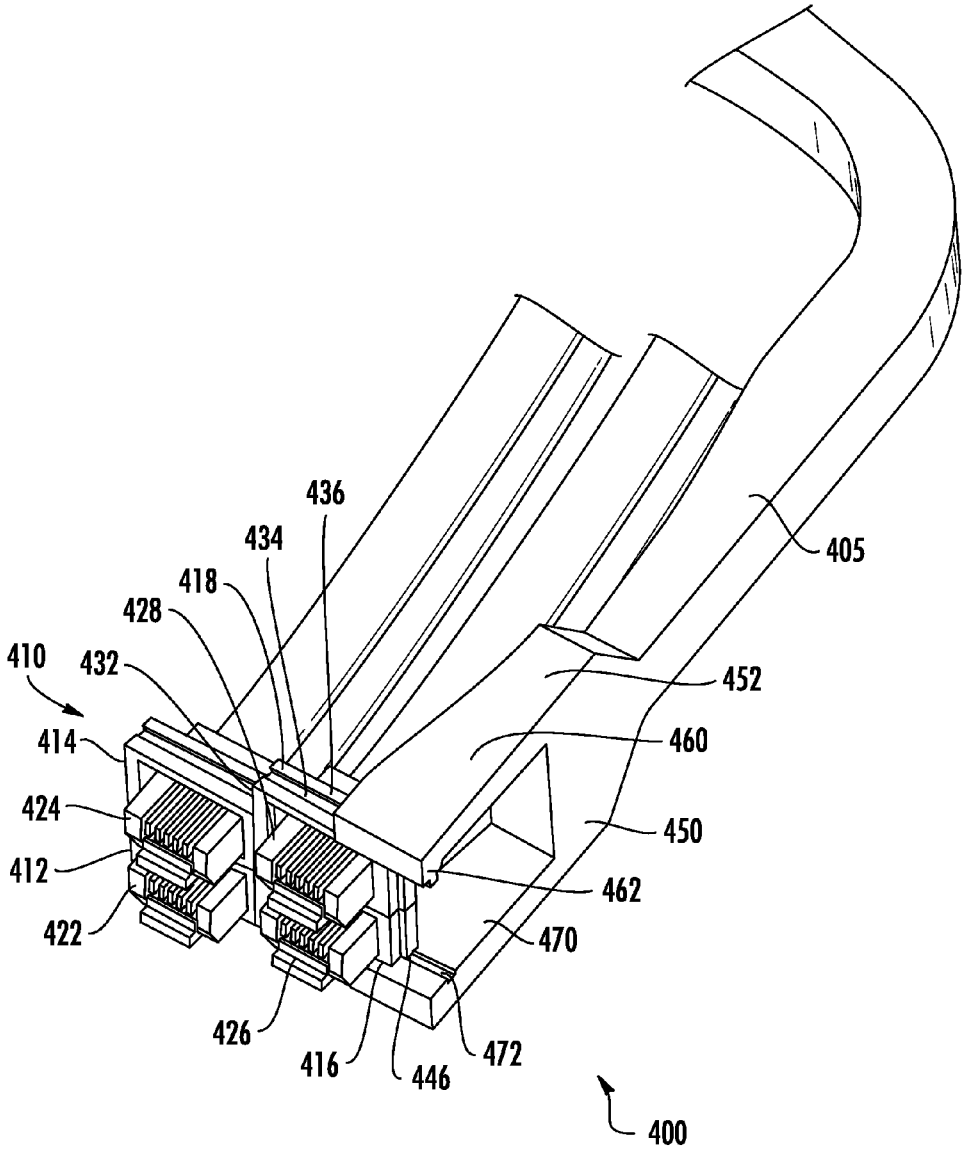
FIG. 4 depicts a block diagram of a manipulator arm in communication with a housing assembly.

Once an assembly of housings is configured via the "building block" of housings, the assembly as a whole may be manipulated. Referring to FIG. 4, a block diagram (400) of a manipulator arm (405) in communication with a housing assembly (410) is shown and described. In the example shown herein, the housing assembly (410) is comprised of four housings (412), (414), (416), and (418). Each of the separate housings within the assembly is shown with a received connector. More specifically, housing (412) is shown with received connector (422), housing (414) is shown with received connector (424), housing (416) is shown with received connector (426), and housing (418) is shown with received connector (428). An opening (434), also referred to herein as a channel or recess, is formed between the two walls (432) and (436) of housing (416) is shown. As described in FIG. 1, the opening (434), also referred to herein as a channel or recess, is also sized to receive an interlock from a corresponding projection of a housing. However, in the case of a manipulator arm (405), a fork (450) is provided with two prongs, (460) and (470), respectively, adjacent to a proximal end (452). Each prong (460) and (470) is configured to attach to a different wall of the housings within the assembly (410). In the example shown herein, prong (460) includes a tapered projection (462) sized to be received by corresponding recess (434) in housing (414), so that the prong (460) interlocks with the assembly (410) at recess (434). Similarly, in the example shown herein, prong (470) includes a tapered recess (472) sized to receive a corresponding projection (446) of housing (416), so that the prong (470) interlocks with assembly (410) at projection (446).

Once the two prongs (460) and (470) of the fork (454) are secured to the assembly (410), the arm (405) may manipulate the assembly (410) as a whole. In one embodiment, each connector received in the assembly housing(s) functions similar to a plug to be received by a corresponding outlet. The arm (405) is employed as a mechanical device to insert or remove the assembly (410) in a single manipulation. For example, the arm (405) may be employed to deliver all four connectors (422), (424), (426), and (428) in a single manipulation. Similarly, the arm (405) may be employed to remove all four connectors (422), (424), (426), and (428) in a single communication. The arm (405) effectively removes the requirement to separately manipulate delivery or removal of a connector in a single connector basis. In one embodiment, upon receipt the connectors are positioned in an area that is difficult to reach, wherein, the arm (405) may enter this area within minimal difficulty. Accordingly, the arm (405) manages delivery and removal of multiple connectors to adjacently positioned receivers (not shown).

Figure 5:
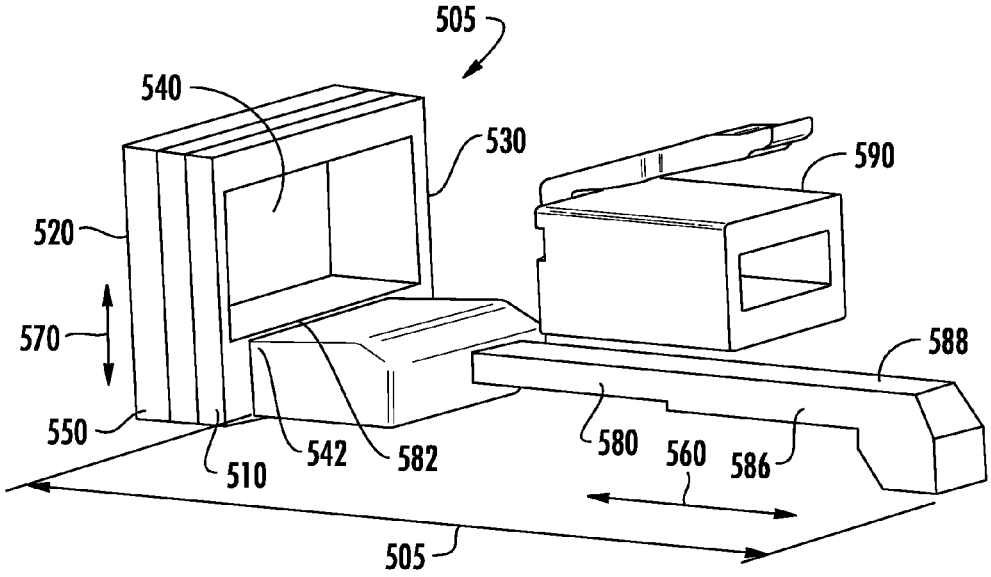
FIG. 5 depicts a block diagram illustrating another embodiment for adjusting the size of the primary aperture of the housing.

The adjuster shown in FIG. 1 changes the size of the primary aperture through an adjuster placed or formed in the side wall of the housing. The adjuster shown in FIG. 2 is placed or formed within the aperture. More specifically, the adjuster shown in FIG. 2 may be manipulated from a front side of the housing or a back side of the housing. With references to FIG. 5, a block diagram (500) is provided illustrating another embodiment for adjusting the size of the primary aperture of the housing. The housing is shown including a first wall (510) and a second wall (550), similarly configured to the housing of FIG. 1 so that multiple housings may be attached via their external walls. The housing shown herein (505) includes a front side (520) and an oppositely disposed back side (530). An aperture (540) is shown formed within the housing (505), and sized and configured to receive a connector (590). A secondary assembly (505) is provided to modify the size of the aperture (540). The secondary assembly (505) includes a plate (542) with angled wall (582) a slide (580), and a lever (586). The plate (542) is provided within the aperture (540). In a rest position, as shown herein, the position of the plate (542) represents a maximum size of the aperture. As the position of the plate (542) changes in a first plane (570), the size of the aperture (540) changes. More specifically, the plate (542) is adjustable along a first plane associated with the first planar direction. As the plate changes position in the first plane, the size of the aperture (540) decreases or increases, depending on the original position of the plate (542). Accordingly, the plate (542) is capable of moving on one of two directions in the first plane (570), with the movement to increase or decrease the size of the aperture (540), with the maximum size of the aperture (540) defined by the walls of the housing.

The slide (580) is provided in communication with the plate (542). More specifically, the slide (580) has an angled wall (582) is communication with the plate (542) and lever (586) at an oppositely disposed second end (588). The slide (580) is configured to move in a second plane (560), oppositely disposed from the first planar (570) movement associated with the plate (542). As the slide (580) moves in a second plane (560) toward the housing (505), the angled wall (582) of the plate (542) within the aperture (540) increases. This movement of the slide (580) in the second plane (560) causes the plate (542) to rise within the aperture (540) in the first plane (570) thereby decreasing the size of the aperture (540). Similarly, movement of the arm (580) in an opposite second plane, e.g. away from the housing (505), decreases the position of the angled wall (582), thereby resulting in a lowering of the plate (542) within the aperture (540) so that the size of the aperture (542) increases. In one embodiment, the size of the connector (590) received within the aperture (540) is defined by the range defined by the wall (582). In one embodiment, the interior walls of the housing as defined by the aperture (540) are provided with a high friction surface to hold a received connector within the aperture (540). Similarly, in one embodiment, the slide (580) and associated lever (586) are positioned on an opposite side of the housing from where the connector is received. Accordingly, in one embodiment, the slide (580) and lever (586) assembly move in the first plane (570) to change the position of the plate (542) and decrease the size of the aperture (540) to hold the received connector (590) within the walls of the housing, and move in a second plane (560) to release the plate (542) and increase the size of the aperture (540) thereby enabling a release of the connector (590) from the housing (505).

As shown in FIGS. 1-5, the housing and associated adjusters are provided to change the opening of the housing to receive different sized connectors. At the same time, multiple housings may be interconnected into an assembly in the form of an array or a matrix and configured to receive an arm to enable the assembly and associated connectors to be manipulated in a single movement.

Figure 6A:
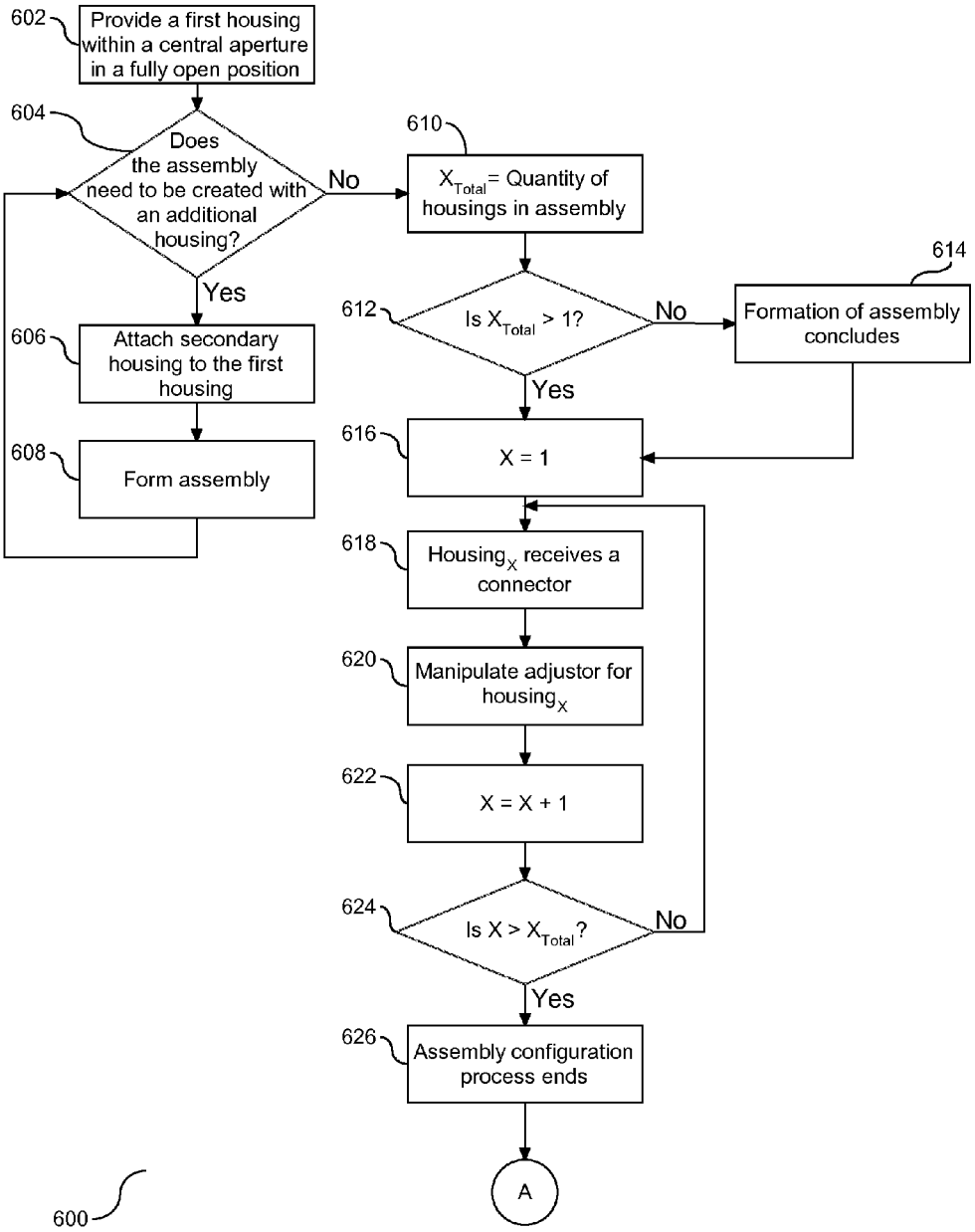
FIGS. 6A and 6B depict a flow chart illustrating a process for creating the assembly shown and described in FIGS. 1-5.
Figure 6B:
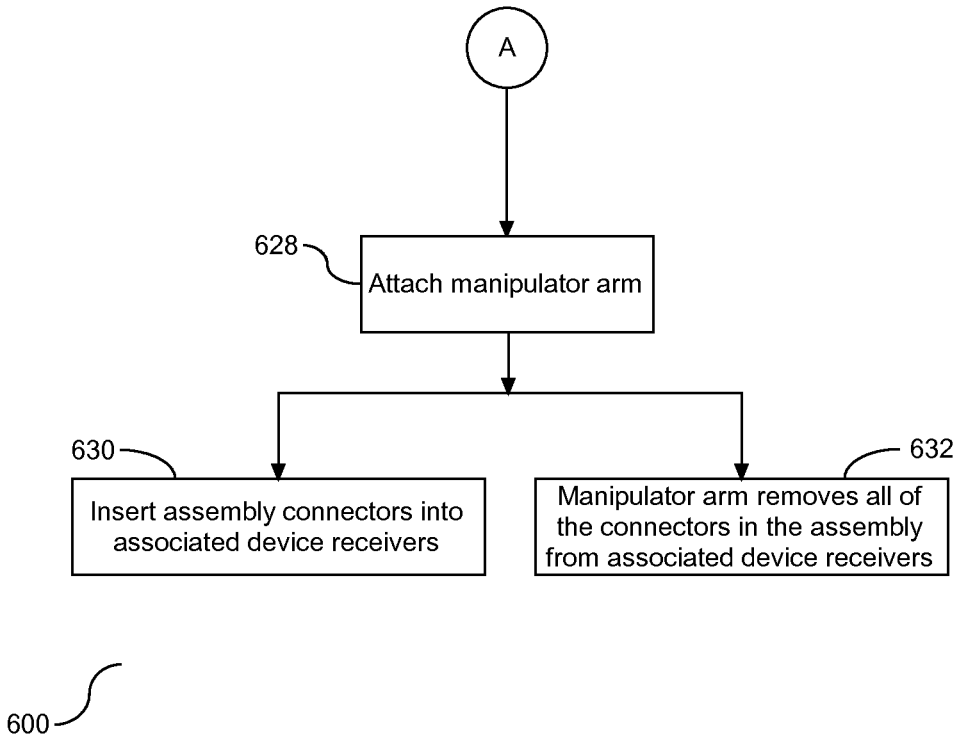

Referring to FIGS. 6A and 6B, a flow chart (600) is provided illustrating a process for creating the assembly shown and described in FIGS. 1-5. A first housing is provided within a central aperture in a fully open position (602). The first housing is a single housing. It is determined if an assembly is to be created with an additional housing (604). A positive response to the determination at step (604) is followed by taking a secondary housing and attaching the secondary housing to the first housing (606). Details of the manner in which the first and secondary housings are attached are shown and described in FIG. 1. Once the housings are secured, an assembly is formed (608), and the process returns to step (604) to determine if the assembly should increase in size. A negative response to the determination at step (604) is following by assessing a quantity of housings in the assembly and assigning the variable $X_{Total}$ to represent the number of housings in the assembly (610). It is then determined if the assembly has at least two housings (612). A negative response to the determination at step (612) concludes the formation of the assembly (614). Each housing, whether individual or as part of the assembly, may be custom fitted to receive and hold a connector. Following a positive response to the determination at step (612) or step (614), an associated housing counting variable is initialized (616). $Housing_X$ receives a connector, $connnector_X$, (618), and an associated adjuster for the housing is manipulated to change the size of the aperture so that the housing holds the received connector (620). In one embodiment, the original size of the aperture may hold the connector and as such, the adjuster may not need to change the size of the aperture. Once the connector is held in place within the housing, the process shown herein concludes.

For an assembly of housing, each housing within the assembly is sized to receive a connector therein. The assembly may be homogenous, in which one or more of the housings in the assembly have the same size apertures to receive and hold a connector having the same size as all other connectors received in the assembly. In one embodiment, the assembly may be heterogeneous, in which one or more of the housings in the assembly have a different sized aperture to receive and hold at least one connector having a different size from the other connectors in the assembly. As shown, for each housing, $housing_X$, in the assembly, an associated adjuster for the housing is manipulated until the connector is held within the aperture of the housing. Furthermore, as shown and described above, there are different forms of adjusters for changing the size of the aperture. Once the connector is placed in the housing, the housing counting variable is incremented (622), followed by determining if all of the housings in the assembly have been processed to receive a connector, and more specifically to hold the received connector (624). A negative response to the determination at step (624) is followed by a return to step (618), and a positive response concludes the assembly configuration process (626).

It is understood that the size of the assembly may be restricted by an associated electronics assembly. More specifically, each connector is configured to be received by an associated electrical component, such as a computer or peripheral device. In one embodiment, the assembly may be configured so that connectors are only received in select housings of the assembly, namely those that correspond to a position of an associated electrical device. Accordingly, one or more housings in the assembly may have an aperture that does not receive an associated connector.

As further disclosed in the assembly of housings, the manipulator arm may be attached to the assembly so that the assembly may be managed from a single device. More specifically, the arm may be employed to insert or remove an assembly in a single movement, without requiring separate movements for each connector and associated housing. As shown herein, at step (626), the assembly is considered complete, and the manipulator arm may attach to the assembly, as shown at step (628). In one embodiment, the attachment of the manipulator arm may take place following step (608), and as such, should not be limited to the embodiment (s) shown herein. Once the assembly is completed, including the attachment of the manipulator arm, all of the connectors received in the assembly may be inserted into their associated receptacles of an electronic or computer related device (s) (630), or in the case where the assembly is connected, the manipulator arm may be employed to remove all of the connectors from the electronic or computer related device(s) (632). Accordingly, the housings are configured as building blocks to enable and support custom configuration of an assembly of connectors with homogeneous or heterogeneous sized openings to receive connectors for an electrical or computer related device(s).

Features not depicted in the Figures described above may be used to hold the connector within the housing, either alone or in conjunction with the described embodiments relating to the adjustment of housing apertures. The housing (s) may be composed of various materials. In one embodiment, at least one of the interior walls of the housing(s) is composed of a high friction material to hold the connector within the housing. The housing(s) may also be modified by the addition of materials. In one embodiment, a rubber insert may be applied to one or more of the interior walls of the housing(s) to hold the connector within the housing(s). In another embodiment, a semi-permanent adhesive may be applied to one or more of the interior walls of the housing(s) to hold the connector(s) within the housing(s).

Furthermore, the described features, structures, or characteristics may be combined in any suitable manner in one or more embodiments. In the following description, numerous specific details are provided, such as examples of agents, to provide a thorough understanding of embodiments. One skilled in the relevant art will recognize, however, that the embodiments can be practiced without one or more of the specific details, or with other methods, components, materials, etc. In other instances, well-known structures, materials, or operations are not shown or described in detail to avoid obscuring aspects of the embodiments.

The present embodiments may be a system, a method, and/or a computer program product. The computer program product may include a computer readable storage medium (or media) having computer readable program instructions thereon for causing a processor to carry out aspects of the present embodiment(s). More specifically, the design and configuration of the assembly may be implemented via a computer program. Similarly, the size of the associated housing apertures configured to receive an associated connector may be adjusted via a computer program. The general method of the assembly configuration is shown and described in FIGS. 6A and 6B.

Figure 7:
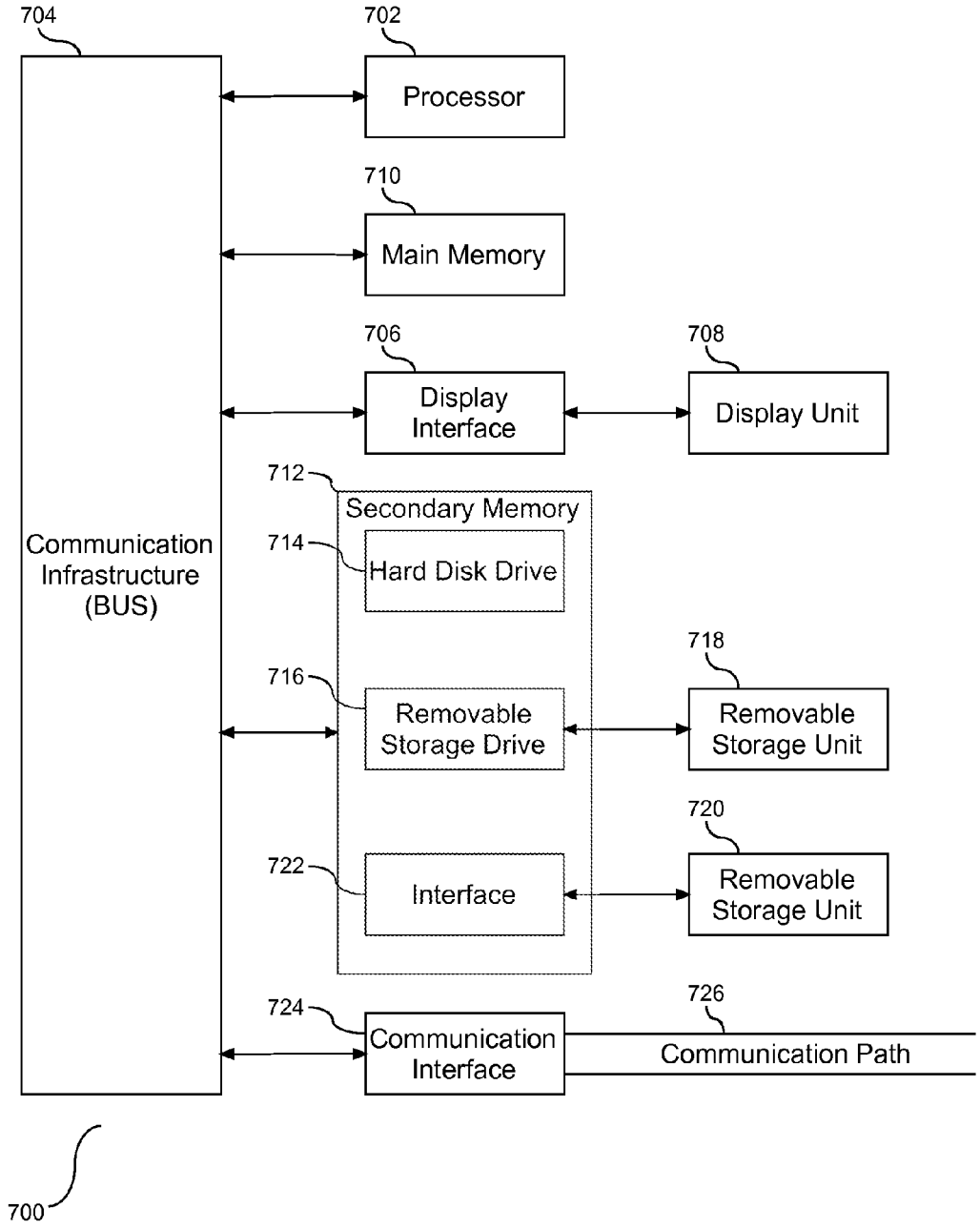
FIG. 7 depicts a block diagram illustrating components of a computer implemented system to support assembly construction and implementation.

Referring now to the block diagram of FIG. 7, additional details are now described with respect to implementing one or more embodiment(s) in a computer program product. The computer system includes one or more processors, such as a processor (702). The processor (702) is connected to a communication infrastructure (704) (e.g., a communications bus, cross-over bar, or network).

The computer system can include a display interface (706) that forwards graphics, text, and other data from the communication infrastructure (704) (or from a frame buffer not shown) for display on a display unit (708). The computer system also includes a main memory (710), preferably random access memory (RAM), and may also include a secondary memory (712). The secondary memory (712) may include, for example, a hard disk drive (714) and/or a removable storage drive (716), representing, for example, a floppy disk drive, a magnetic tape drive, or an optical disk drive. The removable storage drive (716) reads from and/or writes to a removable storage unit (718) in a manner well known to those having ordinary skill in the art. Removable storage unit (718) represents, for example, a floppy disk, a compact disc, a magnetic tape, or an optical disk, etc., which is read by and written to by removable storage drive (716).

In alternative embodiments, the secondary memory (712) may include other similar means for allowing computer programs or other instructions to be loaded into the computer system. Such means may include, for example, a removable storage unit (720) and an interface (722). Examples of such means may include a program package and package interface (such as that found in video game devices), a removable memory chip (such as an EPROM, or PROM) and associated socket, and other removable storage units (720) and interfaces (722) which allow software and data to be transferred from the removable storage unit (720) to the computer system.

The computer system may also include a communications interface (724). Communications interface (724) allows software and data to be transferred between the computer system and external devices. Examples of communications interface (724) may include a modem, a network interface (such as an Ethernet card), a communications port, or a PCMCIA slot and card, etc. Software and data transferred via communications interface (724) is in the form of signals which may be, for example, electronic, electromagnetic, optical, or other signals capable of being received by communications interface (724). These signals are provided to communications interface (724) via a communications path (i.e., channel) (726). This communications path (726) carries signals and may be implemented using wire or cable, fiber optics, a phone line, a cellular phone link, a radio frequency (RF) link, and/or other communication channels.

In this document, the terms "computer program medium," "computer usable medium," and "computer readable medium" are used to generally refer to media such as main memory (710) and secondary memory (712), removable storage drive (716), and a hard disk installed in hard disk drive (714).

Computer programs (also called computer control logic) are stored in main memory (710) and/or secondary memory (712). Computer programs may also be received via a communication interface (724). Such computer programs, when run, enable the computer system to perform the features of the present embodiment(s) as discussed herein. In particular, the computer programs, when run, enable the processor (702) to perform the features of the computer system. Accordingly, such computer programs represent controllers of the computer system.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present embodiment(s) may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present embodiment(s)n.

Aspects of the present embodiments are described herein with reference to flowchart illustrations and/or block diagrams of methods, apparatus (systems), and computer program products according to the described embodiments. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present embodiment(s) has been presented for purposes of illustration and description, but is not intended to be exhaustive or limited in the form disclosed. Many modifications and variations will be apparent to those of ordinary skill in the art without departing from the scope and spirit. The embodiment(s) were chosen and described in order to best explain the principles and the practical application, and to enable others of ordinary skill in the art to understand the various embodiments with various modifications as are suited to the particular use contemplated. Accordingly, the implementation of the housing(s) and interconnection thereof supports creation of the assembly and custom sizing of each housing in the assembly to receive a heterogeneous set of connects.

It will be appreciated that, although specific embodiments have been described herein for purposes of illustration, various modifications may be made without departing from the spirit and scope. In particular, once the assembly is formed, a single connector may be removed without disrupting other connectors in the assembly. For example, when an assembly is in communication, e.g. plugged into, with a system, such as an electronic enclosure, a single cable within the assembly may require replacement. By positioning the retainers, which are also referred to as a retention device, to be accessible from a rear position of the housing, a single cable may be removed without having to disconnect all of the cables in the assembly. Similarly, as disclosed in detail above, one or more recesses and grooves are employed to attach separate housings to create an assembly. Alternative forms of attachments of housings may be employed, including but not limited to, permanent or semi-permanent adhesive, clips, or some other variation of known technologies. In addition, the assembly shown and described herein should not be limited to connecting cables to an electronic enclosure. In one embodiment, the assembly may be used to connect cables to cables, such as when the orientation is critical. Accordingly, the scope of protection is limited only by the following claims and their equivalents.

What is claimed is:

1. An apparatus comprising:

a first housing to receive a first connector, and a second housing to receive a second connector;

the first housing having a first variable aperture, and the second housing having a second variable aperture;

a first retainer to adjust the first aperture and to hold the first connector in the first housing;

a second retainer to adjust the second aperture and to hold the second connector in the second housing; and the first housing having an first external wall sized to receive and secure a second external wall of the second housing, forming an assembly of the connectors.

2. The apparatus of claim 1, further comprising an arm in communication with the assembly configured to manipulate the assembly, wherein the assembly comprises a receiver for the arm.

3. The apparatus of claim 2, wherein the arm manipulates the assembly and simultaneously manages one or more connections associated with the assembly and removal of the assembly and associated connections, the connection and removal being a simultaneous movement of the multiple housings of the assembly.

4. The apparatus of claim 1, further comprising the connectors in the assembly being heterogeneous, wherein the first connector has a first size different from a second size of the second connector.

5. The apparatus of claim 1, wherein the first external wall of the first housing has a recess, and the second external wall of the second housing has a tapered extension sized to be received by the recess, and further comprising receipt of the extension in the receiver to form the assembly.

6. The apparatus of claim 1, further comprising a first adjustment of the first retainer and a second adjustment of the first retainer to modify a size of the first aperture, wherein the first adjustment decreases the first aperture and holds the first connector in the first housing, and wherein the second adjustment increases the first aperture and releases the first connector from the first housing.

7. The apparatus of claim 6, wherein the first retainer comprises a first screw and a second screw, and further comprising the first adjustment of the first screw to adjust the aperture in a first plane and adjustment of the second screw adjusts the aperture in a second plane, wherein the first and second plane are different.

8. The apparatus of claim 6, wherein the first adjustment includes a multi-diameter screw.

9. The apparatus of claim 6, wherein the first retainer includes a slide and an associated plate, and further comprising movement of the slide in a first direction being the first adjustment and movement of the slide in an opposite direction being the second adjustment.

10. The apparatus of claim 1, wherein the external walls of the first and second housings are connectable and stackable.

11. A method comprising:

forming a housing assembly, including securing a first housing to a second housing, wherein the first housing has a first secondary opening received by an extension of the second housing, the first housing including a first central aperture to receive a first connector and the second housing including a second central aperture to receive a second connector;

retaining the first connector in the first central aperture of the first housing, including adjusting the first central aperture of the first housing; and retaining the second connector in the second central aperture of the second housing, including adjusting the second central aperture of the second housing.

12. The method of claim 11, wherein the connectors in the assembly are heterogeneous, the first connector having a first size different from a second size of the second connector.

13. The method of claim 12, further comprising independently modifying a size of the first and second central apertures, the modification creating a heterogeneous assembly.

14. The method of claim 11, further comprising manipulating the assembly from a single device.

15. The method of claim 14, further comprising managing the assembly using the single device, the management selected from the group consisting of:

inserting the retained connectors into respective receivers; and removing the inserted connectors from the receivers;

wherein the insertion and removal each correspond to a simultaneous movement of the housings within the assembly.

16. A system comprising:

an assembly configured to receive a plurality of connectors, each connector received in a central aperture of a separate housing within the assembly;

each housing having a separate retainer, including a first retainer for a first housing and a second retainer for a second housing;

independent adjustment for each retainer to separately modify the associated central aperture for each of the housings to grip the connector in the associated central aperture; and an arm in communication with the assembly, the arm configured to manipulate the assembly.

17. The system of claim 16, further comprising the arm having a first element in communication with a secondary aperture within the assembly, and a second element in communication with a secondary extension within the assembly.

18. The system of claim 16, further comprising management of the assembly using the arm, the management selected from the group consisting of:

inserting the connectors into respective receivers; and removing the inserted connectors from the receivers;

wherein the insertion and removal each correspond to a simultaneous movement of the housings within the assembly.

19. The system of claim 16, wherein the connectors in the assembly are heterogeneous, including a first connector having a first size different from a second size of a second connector.

* * * * *